US006598249B2

(12) United States Patent
Pajanacci et al.

(10) Patent No.: US 6,598,249 B2
(45) Date of Patent: Jul. 29, 2003

(54) METHOD FOR TRIMMING THE LOWER STRUCTURE OF A PIECE OF FURNITURE

(75) Inventors: Marie-Paule Pajanacci, Marseilles (FR); Sophie Pajanacci, Marseilles (FR)

(73) Assignee: So.Tex.Am, Marseilles (FR)

( * ) Notice: Subject to any disclaimer, the term of this patent is extended or adjusted under 35 U.S.C. 154(b) by 163 days.

(21) Appl. No.: 09/936,906

(22) PCT Filed: Jan. 17, 2001

(86) PCT No.: PCT/FR01/00135

§ 371 (c)(1),
(2), (4) Date: Dec. 19, 2001

(87) PCT Pub. No.: WO01/53788

PCT Pub. Date: Jul. 26, 2001

(65) Prior Publication Data

US 2002/0133876 A1 Sep. 26, 2002

(30) Foreign Application Priority Data

Jan. 20, 2000 (FR) ..... 00 00674

(51) Int. Cl.[7] ..... A47G 9/04
(52) U.S. Cl. ..... 5/493; 5/482; 5/923
(58) Field of Search ..... 5/482, 486, 493, 5/496, 498, 499, 922, 923

(56) References Cited

U.S. PATENT DOCUMENTS 3,144,666 A * 8/1964 Mazera et al. ..... 5/493
4,587,683 A * 5/1986 Gardiner ..... 5/493
5,353,456 A * 10/1994 Evans ..... 5/493
5,483,712 A 1/1996 Greenwood
5,621,931 A 4/1997 Hamilton
5,715,553 A * 2/1998 Baron et al. ..... 5/493
5,733,397 A 3/1998 McDaniel
6,035,469 A * 3/2000 Schrougham ..... 5/493
6,276,009 B1 * 8/2001 Schrougham ..... 5/493

* cited by examiner

*Primary Examiner*—Robert G. Santos
(74) *Attorney, Agent, or Firm*—Browdy and Neimark

(57) ABSTRACT

The invention concerns a method for trimming the lower structure of a piece of furniture such as a bed or a couch which consists in covering the sides of said structure with a generally rectangular elongated strip. The invention is characterized in that, in order to adjust the height of said strip on the side, and adapt the length of said strip to the size of the structure to be covered, it consists in: providing the edge of the strip upper part with at least a system of catching elements comprising a series of male or female catching elements over a length of at least five centimeters, framed on each side in the strip longitudinal direction with a series of respectively matching male and female catching elements over a length of at least five centimeters each; locking on the structure the ends of the strip and folding back the strip at the system of catching devices causing them to co-operate to form a recessed fold, to adjust the length of the strip to the length of the structure to be trimmed, to constitute, over the length of the structure, an edge urged to be supported on the top thereof, and to adjust the height of the strip to the height of the structure.

17 Claims, 3 Drawing Sheets

METHOD FOR TRIMMING THE LOWER STRUCTURE OF A PIECE OF FURNITURE

The present application is the national stage under 35 U.S.C. §371 of international application PCT/FR01/00135, filed Jan. 17, 2001 which designated the United States, and which application was not published in the English language.

The present invention relates to a method for trimming the lower structure of a piece of furniture such as a bed or a couch as well as a strip of fabric to form such a trimming.

For a long time, attempts have been made to hide the lower structures of pieces of furniture such as bed bases or the structure of couches which are considered to be anaesthetic. Thus, WO-A-99/03378 relates to a bed valance of a size and shape such that it can be arranged on top of and around a bed base and under a mattress. Fitted over the whole length and on the upper edge of the valance is an anti-slip friction surface, the latter being firmly wedged between the mattress and the base of the bed.

WO-A-98/38896, for its part describes a mattress cover comprising a peripheral fabric strip with meshes knitted from high-tenacity yarns and elastic yarns. This peripheral strip can be elastically stretched in the longitudinal direction and in the transverse direction and regains its transverse stretching characteristics when it is laundered and dried in a relaxed state.

FR-A-2 750 304 describes a method for covering the top of a piece of furniture in which a trimming which is for example decorative is spread out and this covering is immobilised by means of a cover made of transparent plastic material provided with a strong elastic cord housed in a peripheral hem which is stretched over the said top.

FR-A-2 755 595 describes a ready-to-use trimming for a sofa bed consisting of two mattresses, comprising a fitted sheet with a shape and dimensions corresponding to the two mattresses together, an essentially rectangular quilt cover comprising two front edges and two side edges, sub divided by a centre seam into two symmetrical compartments intended to cooperate with one of the frame elements and provided with means allowing it to be fitted without being fixed onto the mattress in such a way that the centre seam is situated in the seating hollow, and two identical quilts cooperating respectively with one of the compartments of the quilt cover.

It would be desirable to have available a trimming for the lower structure of a piece of furniture, such as a bed or a couch, which is easy to manufacture, cheap and versatile as regards the dimensions to be covered, and attractive.

After lengthy research, the applicant has discovered a method for trimming the lower structure of a piece of furniture and a trimming used for such a purpose, essentially based on the creation of an inverted pleat which is adjustable as to the width of the pleated widths thanks to juxtaposed additional fixing elements.

That is why a subject of the present invention is a method for trimming the lower structure of a piece of furniture such as a bed or a couch in which the sides of the said structure are covered with an generally rectangular elongated strip, characterised in that, in order to adjust the height of the said strip on the side, and adapt the length of the said strip to the size of the structure to be covered, the edge of the upper part of the strip is provided with at least one system of attachment devices comprising a series of male or female attachment devices with a length of at least 5 cm, framed on each side in the direction of the length of the band by a series of additional respectively male or female attachment devices each with a length of at least 5 cm, the ends of the strip are fixed onto the structure and the strip is folded at the system of attachment devices, causing them to cooperate to form an inverted pleat, to adjust the length of the strip to the length of the structure to be covered, to constitute, over the length of the structure, an edge resting on top of the latter, and in order to adjust the height of the strip to the height of the structure.

The piece of furniture can be for sitting on such as a couch or an armchair, a piece of bedding furniture such as a bed, or also in particular a table or shelf. The invention applies equally well to pelmets and canopies.

The length of the strip can range according to use from about 50 cm to 15 m, in particular from about 60 cm to 12 m, preferably from about 70 cm to 10 m and quite particularly from about 2 m to 8 m. In the case of a single bed, this length can for example range from about 4.5 to 8 m, in particular from about 5 m to 7 m. In the case of a double bed, this length can range for example from about 5.5 m to 10 m, in particular from about 6.3 to 8 m and quite particularly from about 6.3 m to 7 m. In the case of a couch, this length can be similar to that of a single bed. The lengths indicated above comprise the length of fabric required for the creation of several decorative inverted pleats. They will generally be less if only a functional pleat is required, that is to say the single pleat necessary to adjust the strip to various structural dimensions.

The height of the strip can for example range from about 15 cm to 1.5 m. In the case of a bed, this height can range for example from about 15 cm to 1 m, in particular from about 30 cm to 80 cm and quite particularly from about 40 cm to 60 cm. In the case of a couch, this height can range for example from about 15 cm to 60 cm, in particular from about 20 cm to 50 cm. In the case of a pedestal table, this height can range for example from about 60 cm to 1.5 m, in particular from about 70 cm to 1 m.

By "side of the structure", is meant the lower vertical sides of the structure, for example the base of a bed, these sides optionally including an empty space constituted for example by the feet of the piece of furniture. The piece of furniture can have any form, for example circular, and in particular rectangular form as in the case of a bed or a couch with a standard form. The part of the strip which is furthest from the ground or from the support on which the piece of furniture rests is called "upper part of the strip".

A first series of male or female devices have been fitted on this upper edge. This first series of male devices can for example be fitted over a length of 5 to 40 cm, in particular 10 to 20 cm. This first series of devices is framed by series of additional respectively male or female devices. This second series of additional devices will spread out over a length of preferably between 10 and 30 cm, in particular 15 and 20 cm. The whole forms a system of attachment devices.

As male or female devices, all of the devices traditionally used in sewing and decoration can be used, in particular press-studs, loops and metal hooks. In such a case, a series of 2 to 10 female press-studs can for example be fitted, each spaced about 1 cm apart in the direction of the length of the strip, framed by two series of for example 10 to 15 corresponding male press-studs aligned with the female series and therefore in the direction of the length of the strip, preferably with the same spacing as the female press-studs.

However, in preferential conditions of implementation, self-gripping bands such as those known under the trademark Velcro® comprising a multitude of attachment devices are used as an attachment device.

In preferential conditions of use, a band with loops is framed with the aid of two bands with hooks in order to form a system of attachment devices.

Thus, when creating an inverted pleat, it will be possible to arrange for the hooks to remain visible whilst the other part of the hooks will cooperate with the band with loops. These hooks or the equivalent (press-studs, hooks or others) can cooperate in particular with a width of fabric including additional fixing devices at appropriate places. In the case of the use of self-gripping bands, a fabric with loops covering for example the whole surface of the base of the bed can thus be used. Moreover, the use of self-gripping bands allows a continuous adjustment, which is not linked to the spacing of the devices.

In preferential conditions for the implementation of the invention, two additional pleats, such as inverted pleats are provided on the strip. These can be fixed. They can then in particular be fitted either side of the system of male and female devices described above. Thus, thanks to the formation of an adjustable inverted pleat of greater or lesser width, it is possible to adjust the fixed inverted pleats at the angles of the structure to be covered. But a person skilled in the art understands that these inverted pleats can also be made adjustable, and in this case, they will advantageously adopt the same structure as above. The use of adjustable inverted pleats makes it possible to increase the degree of adjustability of the trimming.

In further preferential conditions for the implementation of the invention, the additional pleats are fixed and include a series of male devices and a series of female devices situated either side of the pleat, and they are made to cooperate by pleating and attachment to form a corner to receive a corner of the structure. A corner can thus be formed in the strip the angles of which form 90° and are thus fully able to adapt to receive a corner of a base of a bed for example.

In yet more preferential conditions for the implementation of the invention, additional systems of attachment devices are provided on the strip. Thus, the degree of adjustability of the trimming is increased even more. Basically, the trimming according to the invention will include an adjustable inverted pleat but it can moreover include two fixed or adjustable inverted pleats, and in addition for example two, four or six additional pleats, which are adjustable or not.

Preferred conditions particularly suitable for a bed are:

one adjustable inverted pleat, one adjustable inverted pleat plus two fixed pleats, one adjustable inverted pleat plus two adjustable pleats, one adjustable inverted pleat plus two fixed or adjustable pleats plus four other fixed or adjustable pleats.

This last combination corresponds to a "central" pleat across a bed, two corner pleats, two times two fixed pleats along each side. For a couch, three adjustable inverted pleats or one adjustable plus two fixed pleats can in particular be used.

In the case of an elongated structure, it is desirable to firmly maintain the upper part of the strip to avoid it having an irregular height.

That is why, in preferential conditions for the implementation of the invention, fixing devices are fitted to link widths of the fabric of the strip that are fitted on two opposite sides of the structure.

Systems which are well known in the state of the art, such as a system of clips the length of which are adjustable, can be used. However, in the preferential conditions for the implementation of the invention, advantage is taken of fixing elements present on the strip but which are not used. In particular in the case where male and/or female devices remain visible on the edge of the band after trimming of the structure, fixing elements are fitted in such a way as to cooperate with the unused devices. Of course, in the case where no male or female device remains visible, the edge of the strip can be provided with such devices and the same procedure is followed.

Although a series of straps can be used to do this, in preferential conditions of implementation, the fixing elements are integral and are in fact in the form of a width of fabric including the necessary fixing devices at the appropriate positions. For example, for a bed, this width would be about the size of the base of the bed and can in addition serve as protection for the base.

In the case of the use of devices including a self-gripping band with hooks, of Velcro® type, a width of fabric with loops can be used for example of the teased mesh type made for example from polyamide which can cooperate with the self-gripping bands with hooks.

In general, the fixing devices will be of a sufficient number for some to be available for the final fixing with the aid of fixing elements. However, in preferential conditions for the implementation of the invention, additional fixing devices are fitted onto the edge of the strip, in particular strips with additional hooks, the function of which will not be to allow the adjustment of inverted pleats, but only to hold the whole solidly together.

In yet other preferential conditions for the implementation of the invention, each of the ends of the upper part of the strip is provided with a system of attachment devices. For example a piece of self-gripping band with loops is fitted between two pieces of self-gripping band with hooks. By folding one or other part of the strip provided with the band with hooks back onto the part provided with band with loops, the strip can be adjusted to the desired length at the sides of the base of the bed, for example in order to pass from a 1.90 m to a 2 m bed. This device is particularly advantageous for strips which comprise only an adjustable system fitted in the middle of the strip and fixed inverted pleats.

A subject of the present invention is also a strip of fabric specially designed for the implementation of the above method.

A more particular subject of the present application is a generally rectangular strip of fabric to form a trim surrounding the lower structure of a piece of furniture such as a bed or a couch, capable of adapting to different sizes, characterised in that its length is greater than that of the structure to be trimmed, in that its upper part comprises at least one system of attachment devices comprising a series of male or female devices each with a length of at least 5 cm, framed by a series of additional respectively male or female devices and in that its width is comprised between 0.3 and 1.0 m.

Of course, the lower part of the strip does not have to be straight but can for example be scalloped or crenulated.

The preferential conditions of the aforementioned method, also apply to the preferred embodiments of the strip according to the invention.

It can in particular be noted that, in particularly advantageous conditions, the male and female devices comprise Velcro®-type self-gripping bands. Preferably, a band with loops is framed by two bands with hooks.

A strip of fabric preferred according to the present invention comprises for example 7 or 5 and preferably 3 or 1 systems of attachment devices, in particular framed bands. By "system of framed bands", is meant a group of bands with loops framed by two bands with hooks or vice-versa.

In preferred conditions of implementation of the invention, the framing bands are bands with hooks, whilst the framed band is a band with loops. Therefore, usually, part of the bands with hooks will remain available on the underside of the strip.

The invention will be better described by reference to the annexed drawings in which.

Figure 1:
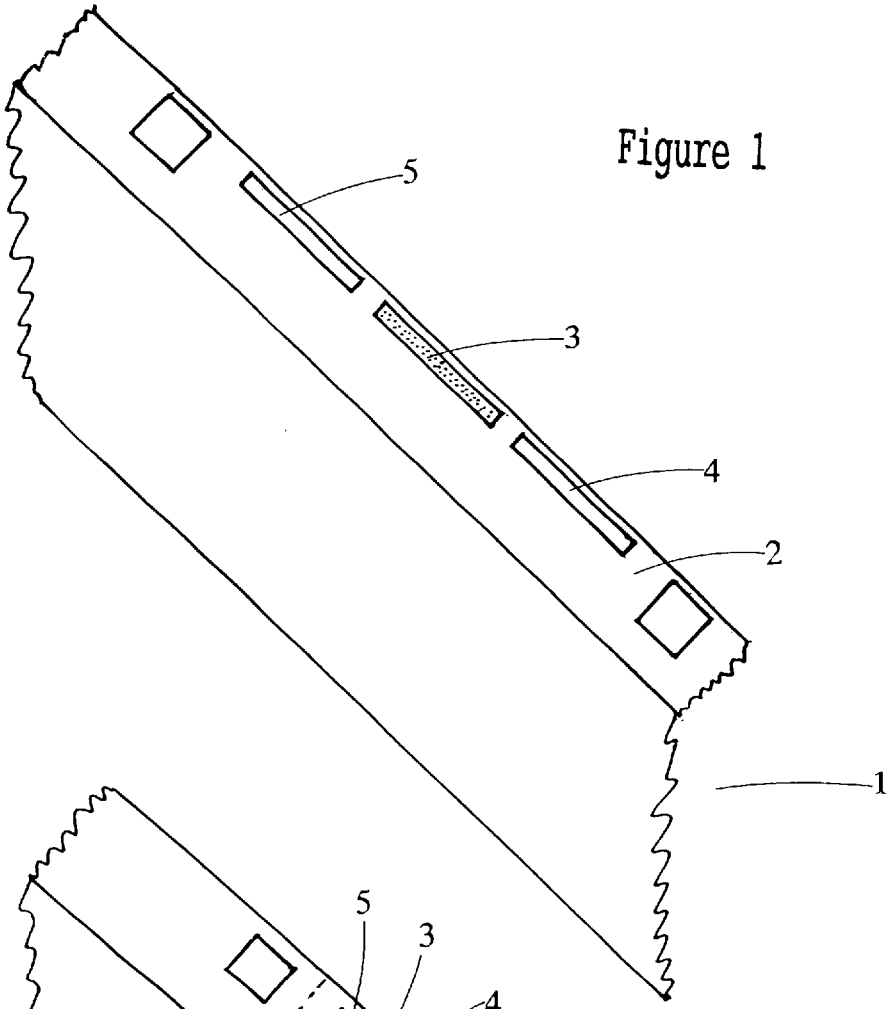
FIG. 1 is a perspective view representing the detail of a system of attachment devices in the open position, fitted onto a strip according to the invention.

In FIG. 1 a piece cut lengthwise from the elongated strip 1 is seen. The upper part 2 of strip 1 is provided on its edge with a system of attachment devices consisting of three aligned self-gripping bands 3,4,5. An attachment band 3 provided with loops (by convention the bands provided with loops are represented by dotted lines) has been fitted between two bands 4, 5 provided with hooks. The central band 3 has a length of 8 cm, whilst the bands 4, 5 which frame it each have a length of 50 cm (the drawing is not to scale).

It will be seen that the strip forms an edge 2 folded at a right angle and resting on the top of the bed base which has not been represented.

Figure 2:
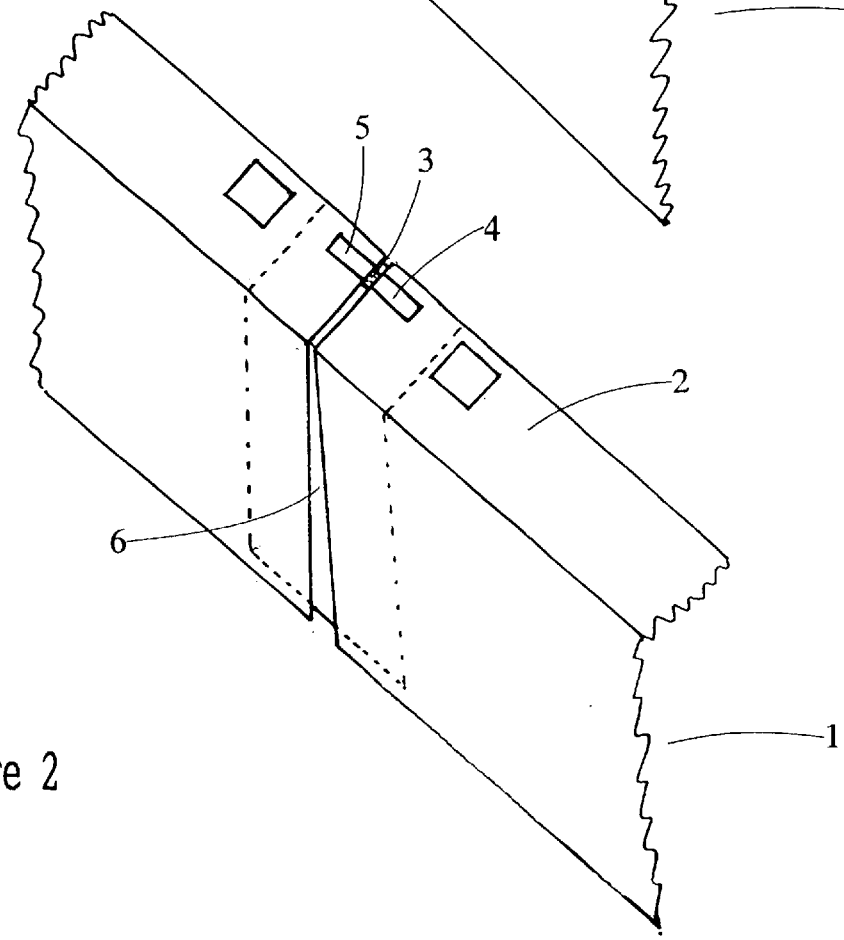
FIG. 2 is a similar view to that of FIG. 1, but in which an inverted pleat has been formed by folding in order to adapt the length of the strip to the desired size.

In FIG. 2, it is seen that the right-hand part and the left-hand part of the piece of strip 1 represented in FIG. 1, carrying self-gripping bands with hooks, is folded onto the part of the strip comprising the self-gripping bands with loops 3. An inverted pleat 6 has thus been formed which reduces the total length of strip 1 accordingly. Thanks to such a system of attachment devices 3, 4, 5 or by combining several such systems, the length of the strip 1 can be adjusted to a determined length, corresponding to that of the structure to be covered, a bed base in the present case.

Figure 3:
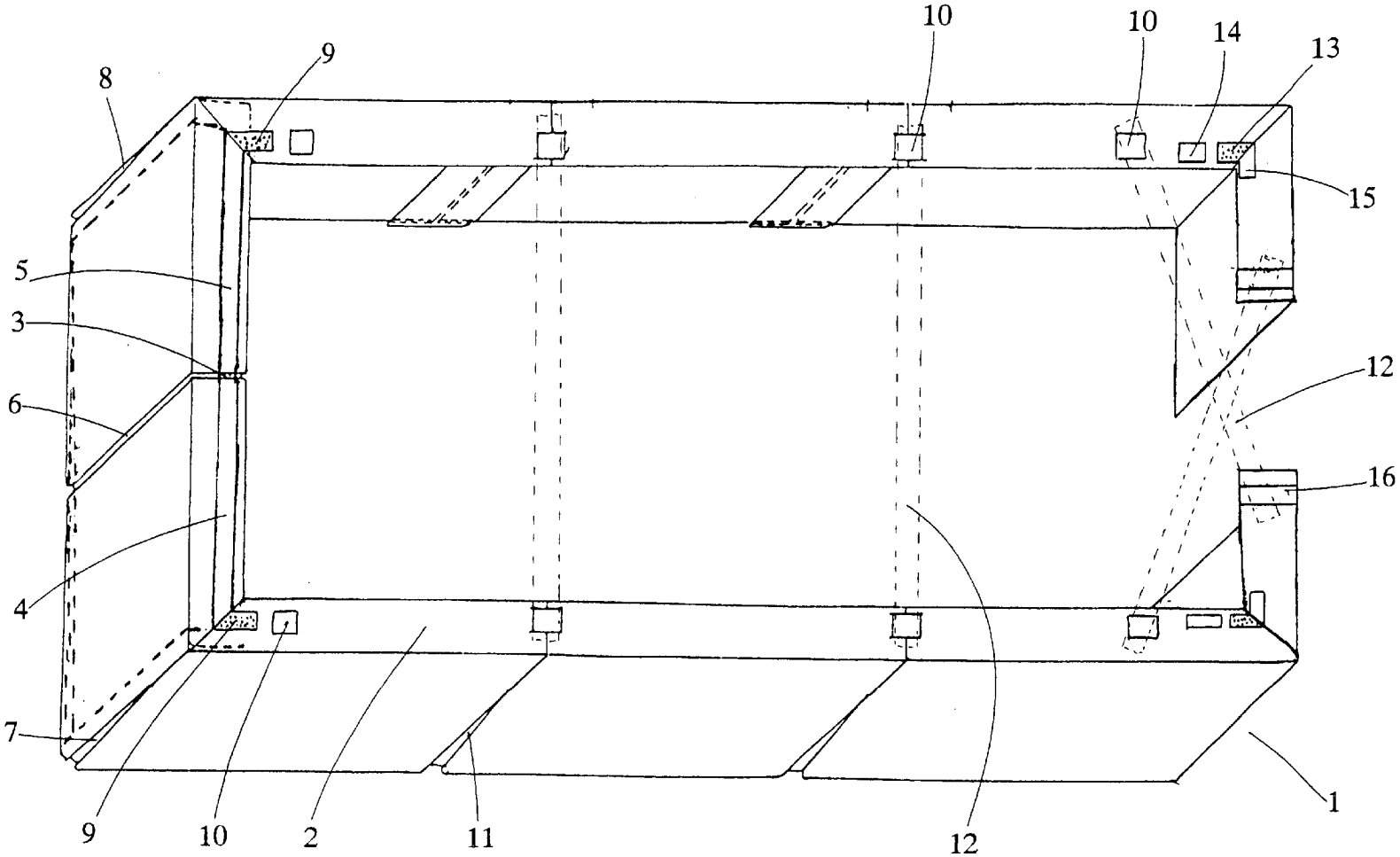
FIG. 3 is a view of a bed base trimmed according to the method and with the aid of a strip according to the present invention, seen from above.

A bed base structure which has been covered according to the method of the present invention can be better observed in FIG. 3. In order to better illustrate the assembly, the bed base itself has not been represented. In this figure, strip 1 can be seen which has been fitted with a single system of attachment devices 3, 4, 5. This system has been fitted in the middle of the width of the bed base corresponding to the middle of the length of the strip. Thanks to the inverted pleat 6 which has been formed, it was possible to have two additional fixed pleats 7, 8 coincide with two of the corners of the bed base. The same can be done with this strip for a double bed; in this case the reverse of the inverted pleat 6 is simply shorter. The self-gripping bands with hooks 4,5, extend in this version to the additional fixed pleats 7, 8. In this represented FIG. 3, the additional pleats 7 and 8 are fixed pleats. If one of these additional pleats is considered, on the edge 2 of the upper part of the band, a piece of self-gripping band with loops 9 (partially hidden by a corner pleat) has been fitted on the other side of the pleat. By folding the large side onto the small one, and therefore the self-gripping band with loops 9 onto the self-gripping band with hooks 4, these two sides have been fixed in order to form a corner and edges with the vertical sides of the strip 1.

For aesthetic reasons, two additional fixed inverted pleats have been fitted on the parts of strip 1 corresponding to the length of the bed base. But it is understood of course that these inverted pleats can be formed according to the same principle as the inverted pleat formed with the aid of the system of attachment devices above. Therefore, in addition to an adjustment in width, an adjustment of the length can be obtained if desired.

When it is wished to fold a side provided with a device with hooks onto a side also provided with a device with hooks, an intermediate piece can be used, for example a fabric with loops with loops on both sides.

Pieces of bands with additional hooks 10 have also been fitted on the edge, so as to properly fix the strips lengthwise as well as widthways, mostly on additional inverted pleats 11 which allows, as well as cooperation with the linking elements 12, reinforcement of the seams here. In order to do this, as represented in the diagram, linking elements 12 have been fitted in the form of straps comprising pieces of self-gripping band with loops at their ends. These linking elements 12, represented by dotted lines although they are situated above the whole, is fix onto small pieces of bands of fabric with hooks 10 fitted periodically according to the length of the band. In a quite particularly preferred version, the straps 12 have been replaced by a width of looped fabric, called "teased mesh", of a size corresponding to that of the bottom of the bed base.

It can be seen that pieces of self-gripping band with loops 9 have been fitted on one side of the additional pleats 7 and 8 and of sufficient length for these pieces of band to protrude after the pleating operation to form the edge and the corner. This additional length is thus available for maintaining the whole by cooperation with linking elements 12 provided with self-gripping bands with hooks. Likewise, the self-gripping bands with hooks 4 and 5 of the "central" system of attachment devices provided here are of great length, of the order of a meter each, to fit bases of both single and double beds, and also in such a way that a length still remains available for the final fixing.

Although this sequence of operation is not obligatory, the ends of the strip had been fixed beforehand to the back of the bed base, corresponding to the bed head.

Towards each end of the strip is also found a system of attachment devices 13, 14, 15 the function of which is explained below, as well as a strip 16 of fabric with hooks which is fifteen or so cm long, extending perpendicularly to the length of the strip.

Figure 4:
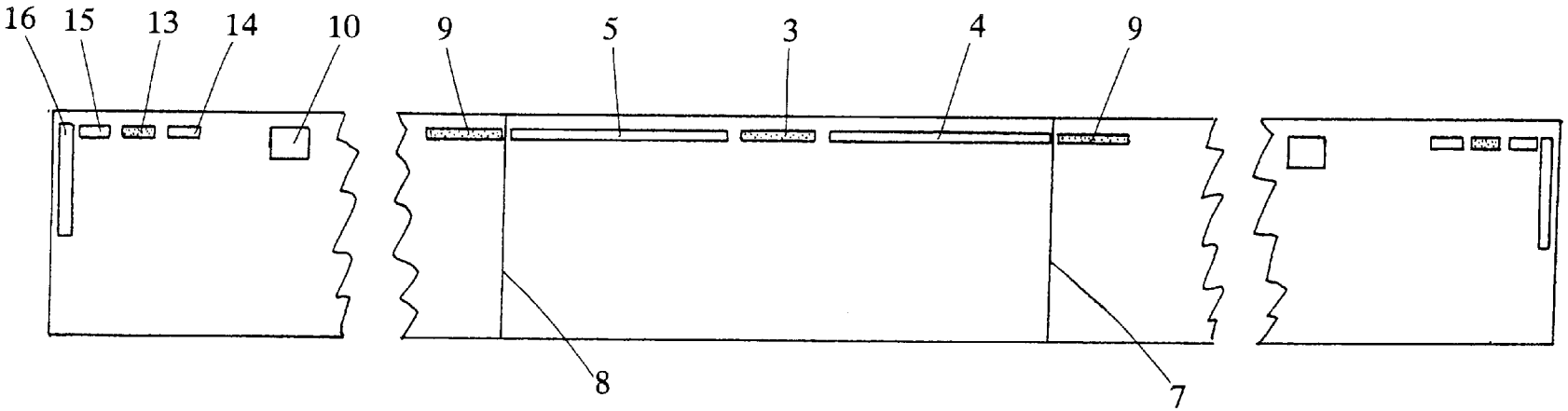
FIG. 4 represents the whole strip according to the invention, seen from above.

In FIG. 4, representing a band measuring 6.4 m by 0.5 m, a band of fabric with loops 3 to 8 cm long framed to left and right by two bands of fabric with hooks 4 and 5 97 cm long, can be distinguished. These bands of fabric with hooks 4 and 5 continue towards the sides of the strip via fixed inverted pleats 7, 8 as well as other fixed pleats (two on each side, not represented). The first fixed pleats 7, 8 receive, on the other side relative to the band of fabric with hooks, a band 9 of fabric with loops 15 cm long.

Finally, as can also be seen in FIG. 4, each of the ends of the upper part of the strip has been provided with an assembly consisting of a band of fabric with hooks 13, 6 cm long, framed by two strips of fabric with loops 14, 15, 3 cm long. By folding back one or other part of the strip provided with hooks onto the part provided with the band with loops 13, the band can be adjusted at the long sides of the bed base to the desired length, for example to pass from a 1.90 m to a 2 m bed. This assembly is particularly advantageous for strips comprising only an adjustable system. In the case of use on the sides, of fixed pleats, as is the case in FIG. 3, this assembly makes it possible to adjust the length of the sides.

Finally, there has been fitted perpendicularly to the length of the strip, a band 16 of fabric with hooks 15 cm long at each end continuing to the other bands of fabric, to also cooperate with the linking elements 12 or in particular a width of fabric with loops.

The fabric with hooks or with loops used in the example above is a fabric 2.5 cm wide except for the bands of fabric with hooks 11 used to cooperate with the linking elements 10, which are squares measuring 3×3 cm.

It can be noted that all of the attachment devices are provided on the same side of the band, which makes its manufacture easy.

What is claimed is:

1. Method for trimming the lower structure of a piece of furniture such as a bed or couch in which the sides of the said structure are covered with a generally rectangular elongated strip (1), characterised in that, in order to adjust the height of the said strip (1) on the side, and adapt the length of the said strip (1) to the size of the structure to be covered, the edge of the upper part of the strip is provided with at least one system of attachment devices comprising a series of first attachment devices (3) with a length of at least 5 cm, each said first attachment device being framed on each side thereof in the direction of the length of the strip by a second attachment device (4,5) with a length of at least 5 cm each, and capable of mating with said first attachment device, the first and second attachment devices being male and female devices, the ends of the strip (1) are fixed onto the structure, and the strip (1) is folded at the level of the system of attachment devices (3,4,5) causing them to cooperate to form an inverted pleat (6), in order to adjust the length of the strip (1) to the length of the structure to be covered, to constitute, over the length of the structure, an edge (5) resting on top of the latter, and to adjust the height of the strip (1) to the height of the structure.

2. Method according to claim 1, characterised in that a structure having a rectangular general form is trimmed.

3. Method according to claim 2, characterised in that two additional fixed or adjustable pleats (7,8) are provided on the strip (1) such as inverted pleats, which are adjusted at two angles of the structure of rectangular form with the aid of the system of attachment devices (3,4,5).

4. Method according to claim 3, characterised in that the additional pleats (7,8) are also adjustable due to a second and third system of attachment devices.

5. Method according to claim 3, characterised in that the additional pleats (7,8) are fixed and comprise a series of male devices (9) and a series of female devices (4, 5) situated either side of each pleat, and they are made to cooperate by pleating and attachment to form a corner to receive a corner of the structure.

6. Method according to claim 3, characterised in that additional systems of attachment devices (10) are provided on the strip (1).

7. Method according to claim 1, characterised in that linking elements (12) are fitted to link widths of the strip (1) fitted on two opposite sides of the structure.

8. Method according to claim 1, characterised in that, in addition, in the case where male and/or female devices remain visible on the edge (5) of the strip (1) after trimming of the structure, linking elements (12) are fitted in such a way as to cooperate with the unused devices, and, in the case where none of the male or female devices would remain visible, the edge of the strip (1) is provided with such devices and the same procedure is followed.

9. Method according to claim 7, characterised in that the linking elements (12) are integral and are in the form of a width of fabric including the necessary fixing devices at the appropriate positions.

10. Method according to claim 1, characterised in that the series of male devices comprises a self-gripping band with hooks and the series of female devices comprises a self-gripping band with loops.

11. Method according to claim 10, characterised in that when a series of devices is framed, it is a band with loops, and in that it is framed by bands with hooks.

12. Method according to claim 10, characterised in that the edge of the strip (1) is provided with bands with additional hooks (10).

13. Method according to claim 9, characterised in that the width (12) is a width of fabric with loops to cooperate with the self-gripping bands with hooks.

14. A generally rectangular strip of fabric (1) to form a trimming surrounding the lower structure of a piece of furniture such as a bed or a couch, capable of adapting to different sizes, characterised in that its length is greater than that of the structure to be trimmed, in that its upper part comprises at least one system of attachment devices (3) comprising a series of first male and female devices with a length of at least 5 cm each, framed on each side by a series of second devices (4,5) capable of mating with said first devices, and in that its width is comprised between 0.3 and 1.0 m.

15. A strip of fabric according to claim 14, characterised in that the male and female devices comprise self-gripping hook and loop fastener bands.

16. A strip of fabric according to claim 15, characterised in that it comprises 1 or 3 systems of attachment devices (3,4,5).

17. A strip of fabric according to claim 15 or 16, characterised in that the framing bands (4,5) are bands with hooks.

* * * * *